US006912994B2

(12) United States Patent
Ozeki et al.

(10) Patent No.: US 6,912,994 B2
(45) Date of Patent: Jul. 5, 2005

(54) ELECTRONICALLY CONTROLLED THROTTLE CONTROL APPARATUS

(75) Inventors: Naomi Ozeki, Toyoake (JP); Shinsuke Miyazaki, Obu (JP); Katsuya Torii, Anjo (JP); Masato Arai, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/683,123

(22) Filed: Oct. 14, 2003

(65) Prior Publication Data

US 2004/0129253 A1 Jul. 8, 2004

(30) Foreign Application Priority Data

Oct. 25, 2002 (JP) ..... 2002-311140

(51) Int. Cl.[7] ..... F02D 9/08
(52) U.S. Cl. ..... 123/399; 123/337
(58) Field of Search ..... 123/399, 337; 251/305

(56) References Cited

U.S. PATENT DOCUMENTS

| | | | | | |
|---|---|---|---|---|---|
| 6,039,027 | A | * | 3/2000 | Sato et al. | 123/399 |
| 6,067,958 | A | * | 5/2000 | Kamimura et al. | 123/337 |
| 6,070,852 | A | * | 6/2000 | McDonnell et al. | 251/129.11 |
| 6,095,488 | A | * | 8/2000 | Semeyn et al. | 251/129.12 |
| 6,173,939 | B1 | * | 1/2001 | Dottavio et al. | 251/129.12 |
| 6,295,968 | B2 | * | 10/2001 | Torii et al. | 123/399 |
| 6,347,613 | B1 | * | 2/2002 | Rauch | 123/337 |
| 6,360,718 | B1 | * | 3/2002 | Wicker | 123/396 |
| 6,386,178 | B1 | * | 5/2002 | Rauch | 123/337 |
| 6,491,019 | B1 | * | 12/2002 | Apel | 123/337 |
| 6,508,455 | B2 | * | 1/2003 | Rauch et al. | 251/305 |
| 6,543,417 | B2 | * | 4/2003 | Tanaka et al. | 123/399 |
| 6,581,569 | B2 | * | 6/2003 | Arsic et al. | 123/399 |
| 2004/0084016 | A1 | * | 5/2004 | Torii et al. | 123/399 |

FOREIGN PATENT DOCUMENTS

| | | | | |
|---|---|---|---|---|
| EP | 992 662 | | 4/2000 | |
| EP | 1413723 | * | 4/2004 | F02D/11/10 |
| JP | 6-45287 | | 6/1994 | |
| JP | 173169 | * | 6/1999 | F02D/9/02 |

* cited by examiner

*Primary Examiner*—Hai Huynh
(74) *Attorney, Agent, or Firm*—Nixon & Vanderhye PC

(57) ABSTRACT

In a gear case of a throttle body, a valve gear is fixed to one end of a throttle shaft, an intermediate reduction gear is rotatable around an intermediate shaft, a pinion gear is fixed to a motor shaft of a drive motor, and a full close position stopper is provided for defining the full close position of a throttle valve. Those are provided all in alignment with the longitudinal centerline of the gear case. For car models where the throttle body bore inside diameter is identical but the rotation direction of the drive motor differs, only some components in the gear case need be replaced and the other components in the gear case can be used as common components.

19 Claims, 12 Drawing Sheets

ELECTRONICALLY CONTROLLED THROTTLE CONTROL APPARATUS

CROSS REFERENCE TO RELATED APPLICATION

This application is based on and incorporates herein by reference Japanese Patent Application No. 2002-311140 filed on Oct. 25, 2002.

FIELD OF THE INVENTION

The present invention relates to an electronically controlled throttle control apparatus which controls the opening degree of a throttle valve by means of a drive motor to control the flow rate of intake air which flows through the bore of the throttle body into an internal combustion engine. In particular, the present invention relates to an electronically controlled throttle control apparatus which makes it possible to use, as common components, a gear case and a gear cover which house motor torque transmission system components such as a reduction gear and other components.

BACKGROUND OF THE INVENTION

An electronically controlled throttle control apparatus has a throttle valve to open and close the bore of throttle body by the torque of a drive motor shaft, and an engine control apparatus to control the engine rotation speed by driving the drive motor depending on the driver's accelerator pedal depression to set the opening degree of the throttle valve to a specific opening degree. In the electronically controlled throttle control apparatus, the gear case is integrally formed on the outer wall surface of the throttle body. The gear case rotatably houses the following gears as components of a transmission system which transmits the torque of the drive motor to the throttle shaft: a valve-side gear (driven gear) fixed to one end of the throttle shaft which rotates integrally with the throttle valve; a motor-side gear (drive gear) fixed to one end of the drive motor shaft; and an intermediate gear, located between the valve-side gear and the motor-side gear, which rotates around the intermediate shaft.

This construction is intended to provide an opener function (default spring function or limp-home function) which enables a car to move to a safe place without a sudden engine stop even if an electrical current to the drive motor is interrupted for some reason. Here the opener function is provided by using different spring forces of plural coil springs to mechanically hold the throttle valve in a prescribed intermediate position (intermediate stopper position) between its full close position and full open position. This constructions is disclosed in, for example, EP 0992662 A2 (JP-A-2000-110589).

This electronically controlled throttle control apparatus has a double coil spring structure. In double coil spring structure, the terminal hooks of both a first spring as a return spring and a second spring as a default spring are held on an intermediate stopper member which is housed in the gear case and in an intermediate stopper position. The ends of the first and second springs are wound in different directions. The valve-side gear, the motor shaft of the drive motor, the motor-side gear, and the intermediate gear are arranged in a displaced manner with respect to the throttle shaft. Given this arrangement, the size of the gear case of the electronically controlled throttle control apparatus is decreased in the longitudinal direction (for example, in the vertical direction), the direction being perpendicular to the direction of the intake air flow. It is to be noted that the opening of the gear case is closed by the gear cover in a liquid-tight manner.

However, in the above electronically controlled throttle control apparatus, the bore inside diameter of the throttle body, the outside diameter of the throttle valve and the shape of the valve-side gear have to be varied depending on the engine displacement, car model, etc. or the drive motor rotation direction. Here, the bore inside diameter of the throttle body is adopted in the range from 40 mm to 80 mm depending on the difference of engine displacements. This gives indication of a possibility that the same gear cover, intermediate gear and motor-side gear as components housed in the gear case are commonly used regardless of the engine displacement or car model. In other words, they are commonly used even when the bore inside diameter of the throttle body or the drive motor rotation direction differs.

However, even when the bore inside diameter of the throttle body is identical, it has been difficult to commonly use the same components to be housed in the gear case integrally formed on the outer wall surface of the throttle body, regardless of the engine displacement or car model, for the following reasons.

The rotation direction of the drive motor and the valve-side gear is different between the right-hand drive car and the left-hand one. The former has a steering mechanism on the right in the car body longitudinal direction, and the latter has a steering mechanism on the left. The arrangement of the components in the gear case of the former and that of the latter are symmetric, or mirror images of each other with respect to the longitudinal centerline of the gear case. This means that the full open position stopper and the intermediate position stopper as well as the return spring terminal hook and the default spring terminal hook are positionally different. Besides, the winding direction of two coil springs should be different and the shape of the valve-side gear should be different and these components should be designed for each model.

SUMMARY OF THE INVENTION

It is therefore an object of the present invention to provide an electronically controlled throttle control apparatus assumed to be used for all car models that enables decreasing the number of components housed in the gear case thereby to offer a cost reduction.

To achieve the object, the present invention provides an electronically controlled throttle control apparatus in which only some components in a gear case need to be replaced and the other components in the gear case can be used as common components regarding different car models which have throttle bodies with the same bore inside diameter and drive motors and valve-side gears which are different in rotation direction.

According to the present invention, in a gear case which is integrally formed on the outer wall surface of a throttle body, at least a throttle shaft, an intermediate shaft and a motor shaft are in alignment with each other. Hence, even when the rotation direction of the drive motor and the valve-side gear differs among models, the components inside the gear case can be used as common components for presumably all models. Therefore, the components inside the gear case integrally formed on the outer wall surface of the throttle body can be used as common components just by changing the bore inside diameter depending on the engine displacement and the model, namely as far as the bore diameter is identical. When the throttle body bore diameter is identical, the number of required gear case variations (in shape and type) can be almost halved. Thus, for presumably all models, it is possible to decrease the number of components and reduce cost.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

[First Embodiment]

Figure 1:
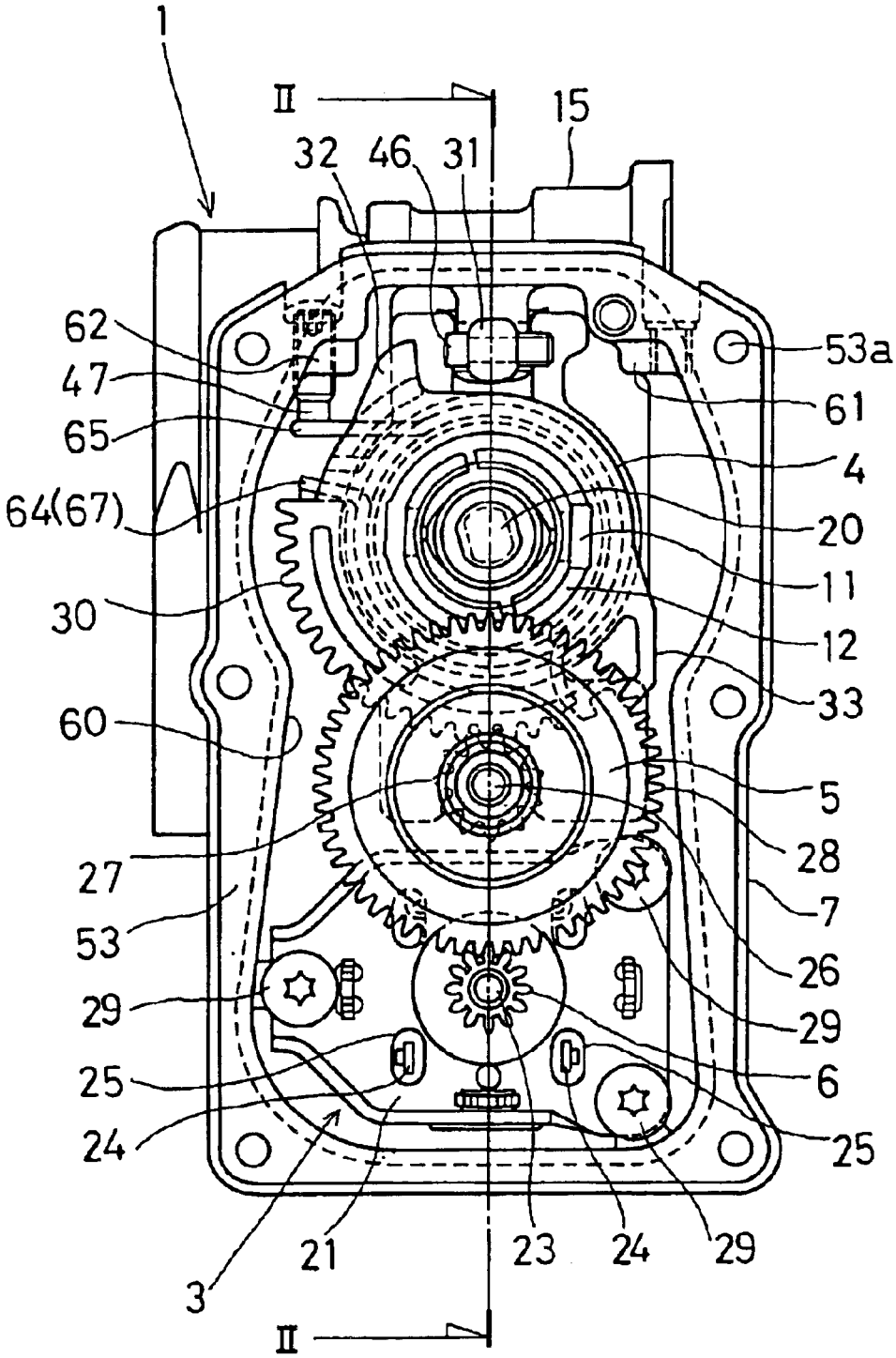
FIG. 1 is a front view showing various components in a gear case integrally formed on the outer wall surface of a throttle body of an electronically controlled throttle apparatus (first embodiment)
Figure 2:
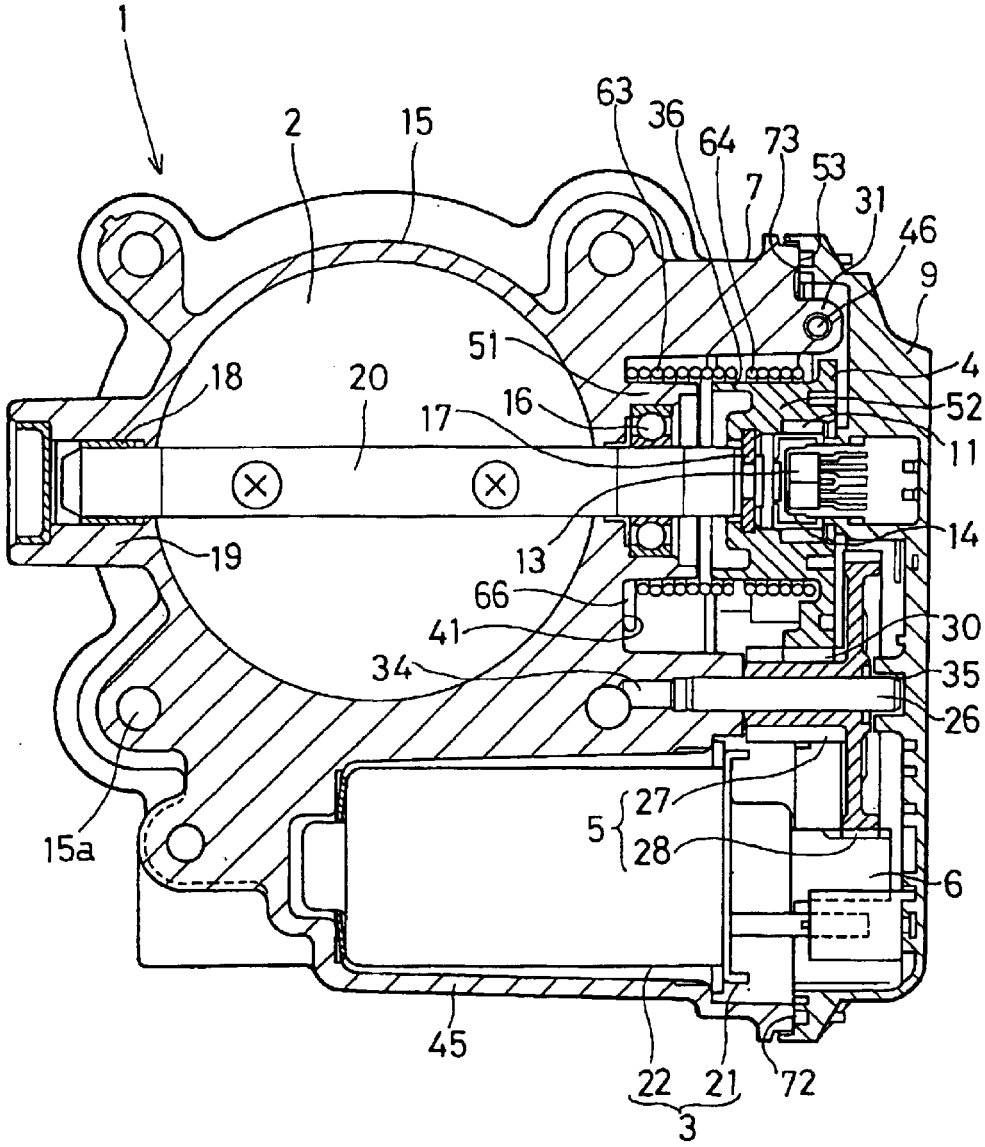
FIG. 2 is a sectional view taken along the line II—II of FIG. 1 (first embodiment)

The electronically controlled throttle control apparatus in the first embodiment is an intake air control apparatus for an internal combustion engine which includes, as shown in FIG. 1 and FIG. 2 in particular: a throttle body 1 which constitutes an intake air passage to an internal combustion engine; a throttle valve 2 which is rotatably supported inside the bore of the throttle body 1; a drive motor 3 as an actuator which opens/closes the throttle valve 2; a reduction gear as a transmission system which transmits the torque of the drive motor 3 to the throttle valve 2; an actuator case which houses the drive motor 3 and the reduction gear; a coil spring fitted between the throttle body 1 and the reduction gear; and an engine control unit (ECU) which electronically controls the drive motor 3.

In this embodiment, the actuator case is composed of: a gear case (gear housing, case body) 7 and a gear cover (sensor cover, cover) 9. The gear case 7 has a concave (recessed) gear holder 60 integrally formed on the outer wall surface of the throttle body 1. The gear cover 9 closes the opening side of the gear holder 60 in the gear case 7 and also holds a throttle position sensor. The electronically controlled throttle control apparatus controls the flow rate of intake air which flows into the engine, depending on the amount of depression of the car accelerator pedal (not shown) to control the engine rotation speed. The ECU is connected with an accelerator position sensor (not shown) which converts the degree of depression of the accelerator pedal into an electric signal (accelerator opening degree signal) to notify the ECU of the accelerator position.

In addition, the electronically controlled throttle control apparatus has a throttle position sensor (throttle opening degree sensor) which converts the opening degree of the throttle valve 2 into an electric signal to notify the ECU of how much the throttle valve 2 is open. The throttle position sensor is composed of: a rotor which is fixed to the right end (as shown) of the throttle shaft 20 by crimping or a similar technique; a separated-type (virtually rectangular) permanent magnet 11 as a magnetic field source; a separated-type (virtually arc) yoke (magnetic material) 12 which is magnetized by the permanent magnet 11; a Hall element 13 integrally provided on the gear cover 9 side facing the separated-type permanent magnet 11; a terminal (not shown) made of conductive sheet metal for connecting the Hall element 13 with the external ECU electrically; and a stator 14 made of ferrous metal material (magnetic material) which concentrates the magnetic flux on the Hall element 13.

The separated-type permanent magnet 11 and the separated-type yoke 12 are fixed with glue or the like on the inner circumferential surface of a rotor insert-molded into a valve gear 4 as one of the reduction gear components. The separated-type permanent magnet 11 lies between two neighboring yokes 12. In this embodiment, the separated-type magnet 11 consists of virtually rectangular permanent magnets arranged vertically as shown in FIG. 2, with the N pole up and the S pole down, in a way that the same polarity is on the same side. The Hall element 13 is a non-contact type detector which is located on the inner side of the permanent magnet 11 and opposite to it. When a N pole or S pole magnetic field is generated on a sensitive surface, an electromotive force is generated in response to the magnetic field (a positive potential is generated with an N-pole magnetic field and a negative potential with an S-pole magnetic field).

The throttle body 1 is a device (throttle housing) made of metal (for example, an aluminum die cast housing) which holds the throttle valve 2 in a way that the valve 2 freely rotates from its full close position to its full open position. It is secured on the intake manifold of the engine using fasteners like fixing bolts or fastening screws (not shown).

The throttle body 1 has: a cylindrical bore wall portion 15 with a bore inside; a cylindrical shaft bearing (hereinafter called the first spring inner guide) 51 which rotatably supports one end (the right end as shown in the figure) of the throttle shaft 20 through a ball bearing 16; and a cylindrical shaft bearing 19 which rotatably supports the other end (left end as shown) of the throttle shaft 20 through a dry bearing 18. There are a plurality of insertion holes 15*a* through which fixing bolts or fastening screws are passed, around the outside of the bore wall portion 15.

The throttle valve 2, which is made of metal or resin and has a virtually disc shape, is a butterfly rotary valve which controls the flow rate of air introduced into the engine. It is inserted into a valve insertion hole (not shown) made in the throttle shaft 20 which rotates integrally with it and secured on the throttle shaft 20 using fasteners such as fastening screws. The throttle shaft 20 is a round bar made of metal and its ends are rotatably or slidably supported by the first spring inner guide 51 and the shaft bearing 19. The right end (as shown) of the throttle shaft 20 has a metal ring 17 for crimping the inner circumference of the valve gear 4 as one of the reduction gear components. The metal ring 17 is insert-molded in the valve gear 4.

The drive motor 3 is a driving source which has a front frame 21 made of metal, a cylindrical yoke 22, a plurality of permanent magnets (not shown), a motor shaft 23, an armature core, an armature coil and the like. The drive motor 3 functions as an electric actuator (driving source) with a motor shaft 23 which rotates when energized through: two motor energizing terminals (not shown); two motor connecting terminals (not shown) connected integrally with the motor energizing terminals and protruding from the gear cover 9 toward the drive motor 3; and two motor feeding terminals 24 detachably connected with the motor connecting terminals.

The two motor feeding terminals 24 are held by two projections 25 (lower ones of four projections 25 on the front frame 21 as shown in the figure) and symmetric with respect to the longitudinal centerline of the gear case 7. The front frame 21 is secured on the outer wall surface of the throttle body 1, namely on the bottom wall surface of the gear case 7, with fixing bolts or fastening screws 29. The front side edge of the yoke 22 is fixed on the front frame 21 by crimping in places or using a similar technique.

The reduction gear decreases the rotation speed of the drive motor 3 at a given reduction gear ratio. It is composed of a valve gear (valve-side gear, driven gear) 4 which is fixed to one end (right end as shown) of the throttle shaft 20 of the throttle valve 2; an intermediate reduction gear (intermediate gear) 5 which rotates by being engaged with the valve gear; and a pinion gear (motor-side gear, drive gear) fixed around the motor shaft 23 of the drive motor 3. As a valve drive means, it rotates the throttle valve 2 and throttle shaft 20.

The intermediate reduction gear 5 is integrally molded of resin into a given shape. It is rotatably engaged around the intermediate shaft 26 as the center of rotation. The intermediate reduction gear 5 consists of a smaller diameter gear 27 which is engaged with the valve gear 4, and a larger diameter gear 28 which is engaged with the pinion gear 6. The pinion gear 6 and the intermediate reduction gear 5 are torque transmission means which transmit the torque of the drive motor 3 to the valve gear 4.

One end (right end as shown) of the intermediate shaft 26 in the axial direction fits into a recess (concave area) 35 made in the inner wall surface of the gear cover 9 and its other end (left end) is pressed into a recess 34 made in the outer wall surface of the bore wall portion 15 of the throttle body 1. The pinion gear 6 is integrally formed from metal into a give shape. It is a motor-side gear which rotates integrally with the motor shaft 23 of the drive motor 3. The intermediate reduction gear 5, pinion gear 6, throttle shaft 20, motor shaft 23, and intermediate shaft 26 are reduction gear components which are housed in the gear case according to the present invention.

The valve gear 4 is integrally molded of resin into a virtually circular ring. Around the bottom part (as shown) of the valve gear 4, there is an integrally formed gear part 30 which is engaged with the smaller diameter gear 27 of the intermediate reduction gear 5. Also integrally formed around the valve gear 4 is a full close stopper 32 which is hooked by a full close position stopper 31 when the throttle valve 2 is fully closed. Also, a full open stopper 33 which is hooked by a first full open position stopper 61 when the throttle valve 2 is fully open is also integrally formed around the throttle valve 4.

As illustrated in FIG. 1 and FIG. 2, in the electronically controlled throttle control apparatus according to the present invention, the following components are arranged along the longitudinal centerline (II—II) of the gear case 7 or in alignment with each other: the throttle shaft 20 of the throttle valve 2; the intermediate shaft 26 which is axially parallel to the throttle shaft 20; the motor shaft 23 of the drive motor 3; the valve gear 4 located inside the gear case 7 of the throttle body 1 and fixed to one end of the throttle shaft 20; the intermediate reduction gear 5 rotatably engaged around the intermediate shaft 26; and the pinion gear 6 fixed to the motor shaft 23.

Figure 3:
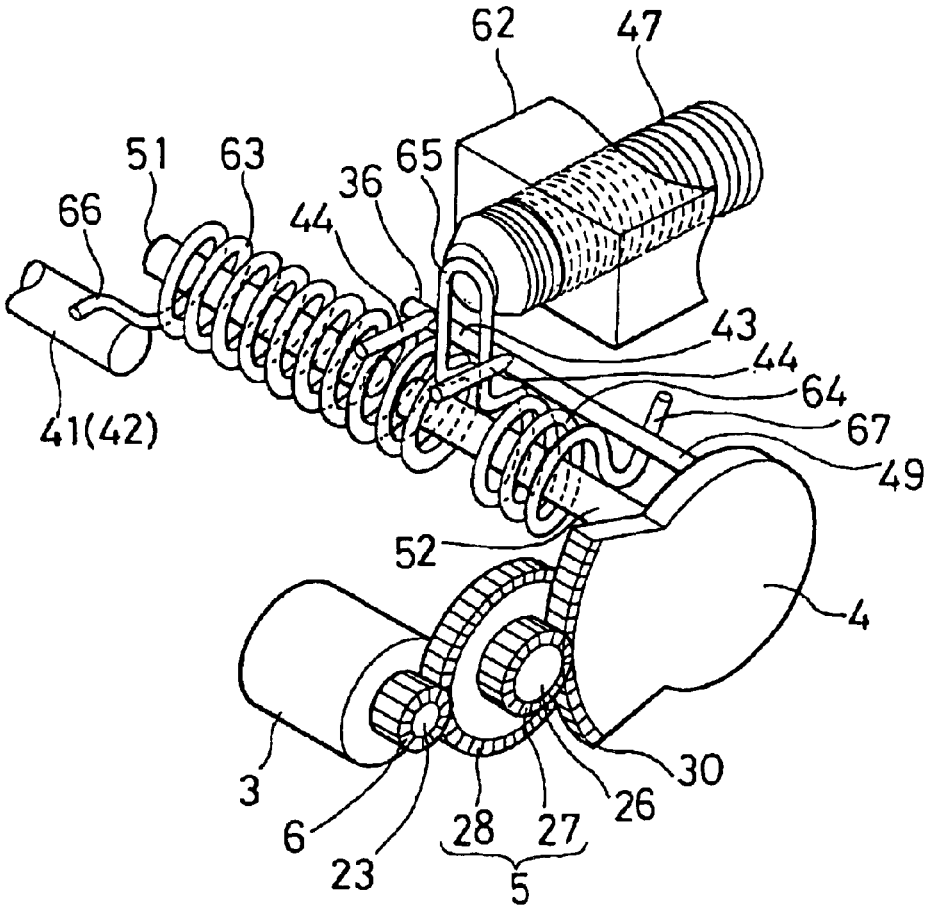
FIG. 3 is a perspective view showing a part of major parts of the electronically controlled throttle control apparatus (first embodiment)

Also, as shown in FIG. 3, there is a coil spring on the outer wall surface (right end face as shown) of the bore wall portion 15 of the throttle body 1, namely between the bottom wall surface (cylindrical and concave) of the gear case 7 and the left end face (as shown) of the valve gear 4. The coil spring has a U-shaped hook portion 65 (made by bending the joint between a return spring 63 and a default spring 64 of the coil spring into a virtually inverted U-shape) held by an intermediate stopper member 47 with its ends wound in different directions.

Protruding to the left (as shown) from, and integrally formed on, the side face (left end face as shown) of the throttle body 1 of the valve gear 4 are a round bar type opener 36 which rotates integrally with the throttle shaft 20 of the throttle valve 2 and a cylindrical second spring inner guide 52 holding the inside diameter side of the default spring 64. In the inside diameter side of the second spring inner guide 52, there is an insert-molded rotor of a ferrous metal (magnetic material).

As illustrated in FIG. 3, the opener 36 has the following components integrally formed on it: a valve gear-side spring hook (second hook) 49 hooking the other end of the default spring 64 of one coil spring; an engaging part 43 detachably engaged with the U-shaped hook portion 65 as the joint between the return spring 63 and default spring 64; and a plurality of anti-slippage guides 44 (adjacent to the engaging part 43) which prevent the U-shaped hook portion 65 of the coil spring from sliding further axially (left/right as shown).

As understood from FIGS. 2 and 3, the second spring inner guide 52 is almost in alignment with the first spring inner guide 51 holding the inside diameter side of the return spring 63 of the one coil spring and has almost the same outside diameter as the guide 51, and is opposite to the guide 51. It holds the inside diameter side of the one coil spring from the return spring 63 in the vicinity of the U-shaped hook portion 65 of the one coil spring to the vicinity of the other end of the default spring 64. The first spring inner guide 51, which is integrally formed protruding to the right (as shown) from the outer wall surface of the bore wall portion 15 of the throttle body 1, namely from the cylindrical concave bottom wall face of the gear case 7, holds the inside diameter side of the return spring 63 of the one coil spring (see FIGS. 2 and 3).

On the bottom side (as shown) of the throttle body 1, or on the bottom side (as shown) of the gear case 7, there is a cylindrical motor housing 45 which is integrally formed and more recessed than the gear housing (gear case) on the top side (as shown). On the top side of the gear case 7 of the throttle body 1, there is a boss type full close position stopper 31 protruding downward (inward) from the inner wall in alignment with the longitudinal centerline of the gear case 7. A full close stopper member (adjust screw with an adjusting screw function) 46 is screwed into this full close position stopper 31. It has a full close position hook which abuts on the full close stopper 32 integrally formed on the valve gear 4 when the throttle valve 2 is fully closed.

On the top side (as shown) of the gear case 7 of the throttle body 1, there is a boss type intermediate position stopper (second full open position stopper) 62 on the left with respect to the longitudinal centerline (II—II) of the gear case 7. The stopper 62 is protruding downward (inward) from the inner wall. An intermediate stopper member (adjust screw with an adjusting screw function, also called the "default stopper") 47 is screwed into this second full open position stopper 62. The stopper member 47 has an intermediate position hook which hooks or holds the throttle valve 2 in a specific intermediate position (intermediate stopper position) between the full close position (full close stopper position) and the full open position (full open stopper position) using the differently oriented forces of the return spring 63 and default spring 64 of one coil spring when an electric current to the drive motor 3 is shut off for some reason.

On the top side of the gear case 7 of the throttle body 1, a boss type first full open position stopper 61 is located symmetrically opposite to the above second full open position stopper 62 on the right with respect to the longitudinal centerline (II—II) of the gear case 7. This first full open position stopper 61 has a full open position hook which abuts on the full open stopper 33 integrally formed on the valve gear 4 when the throttle valve 2 is fully open. The bottom face of the first full open position stopper 61 and the bottom face of the second open position stopper 62 are symmetric with respect to the longitudinal centerline of the gear case 7 and flush with each other.

The one coil spring combines the return spring 63 and the default spring 64 with one coil spring end (end of the return spring 63) and the other coil spring end (end of the default spring 64) wound in different directions. The joint between the return spring 63 and default spring 64 constitutes the U-shaped hook portion 65 which is held by the intermediate stopper member 47 when an electric current to the drive motor 3 is shut off for some reason. The return spring 63 is the first spring which is a coil made of round bar spring steel and has the return function to return the throttle valve 2 from its full open position to an intermediate position through the opener 36.

Figure 4:
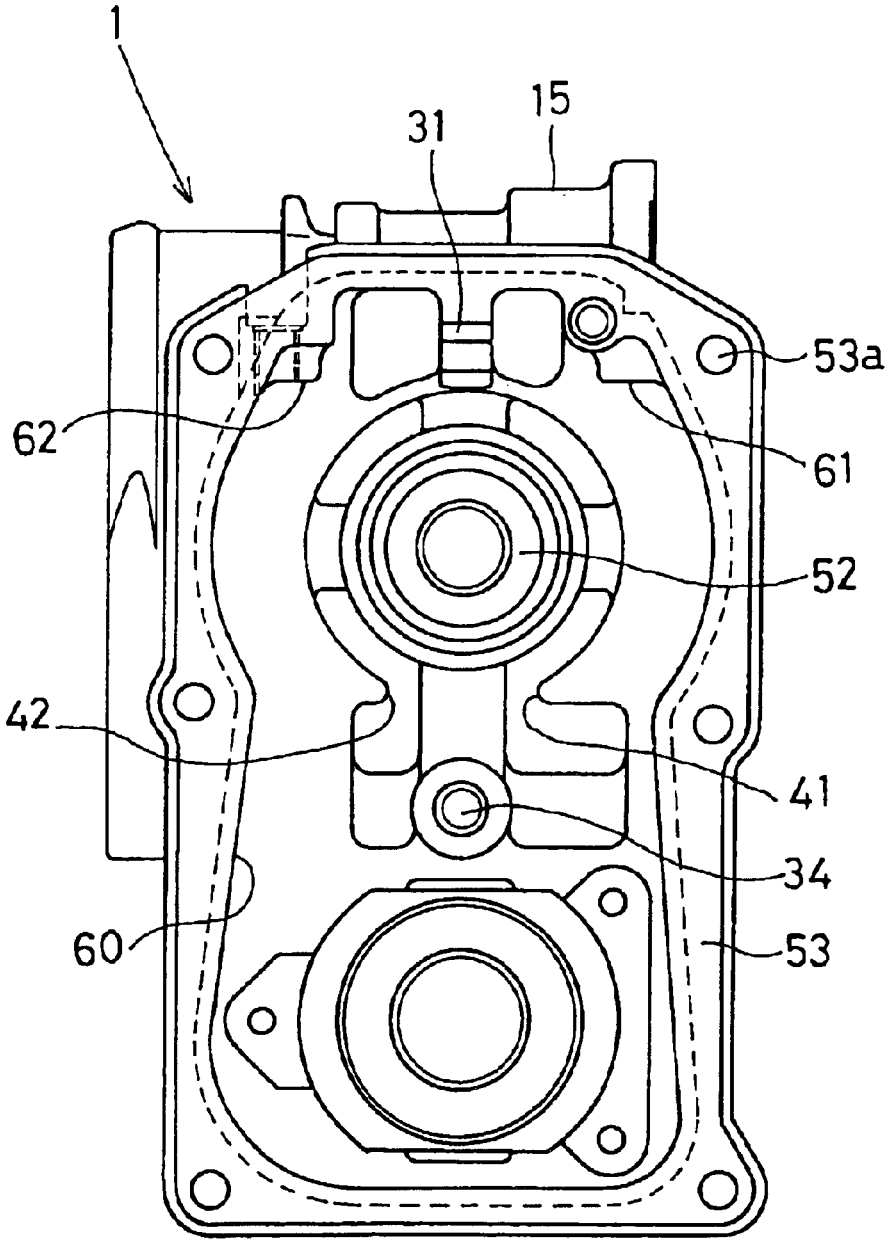
FIG. 4 is a front view showing the gear case integrally formed on the outer wall surface of the throttle body (first embodiment)
Figure 5:
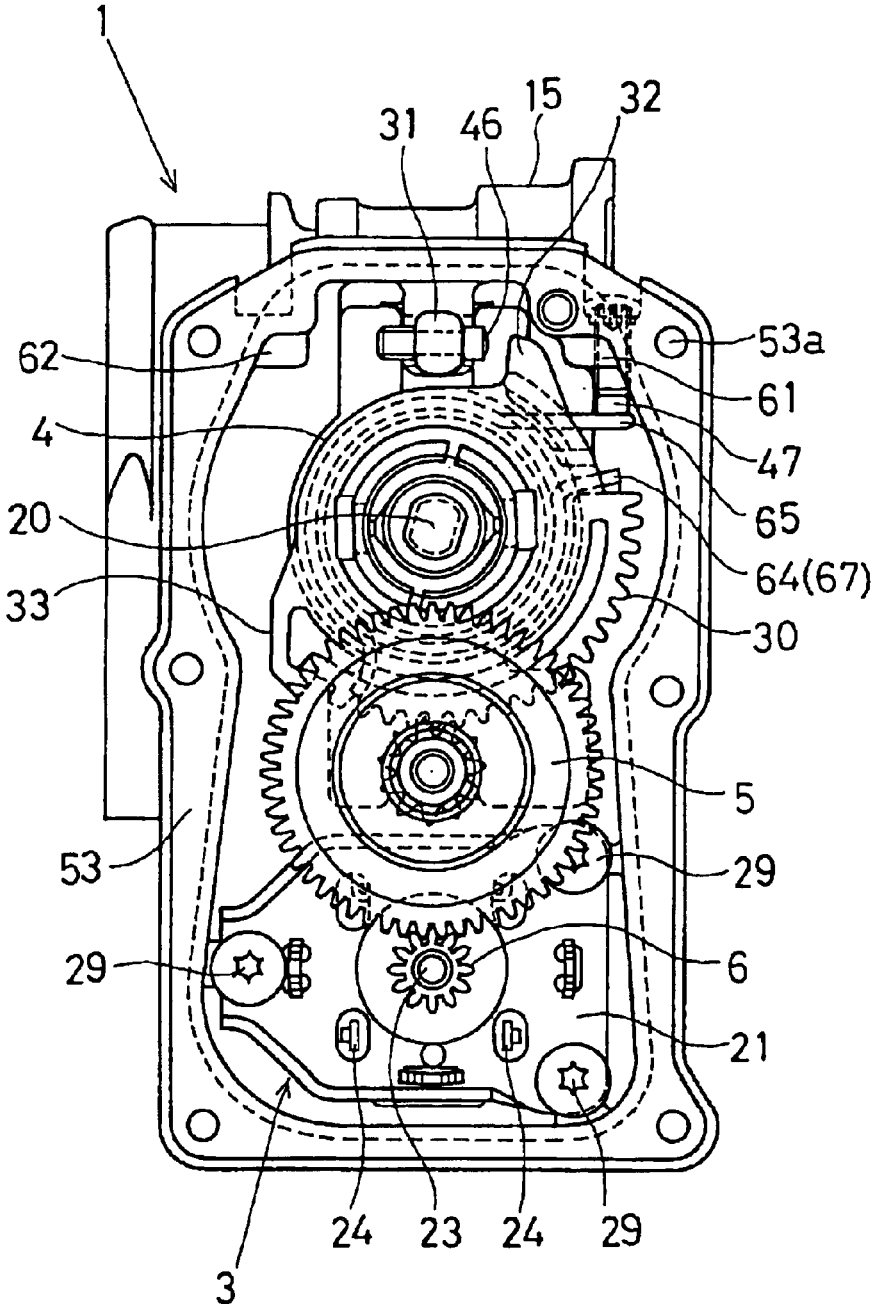
FIG. 5 is a front view showing various components in the gear case integrally formed on the outer wall surface of the throttle body (first embodiment)
Figure 6:
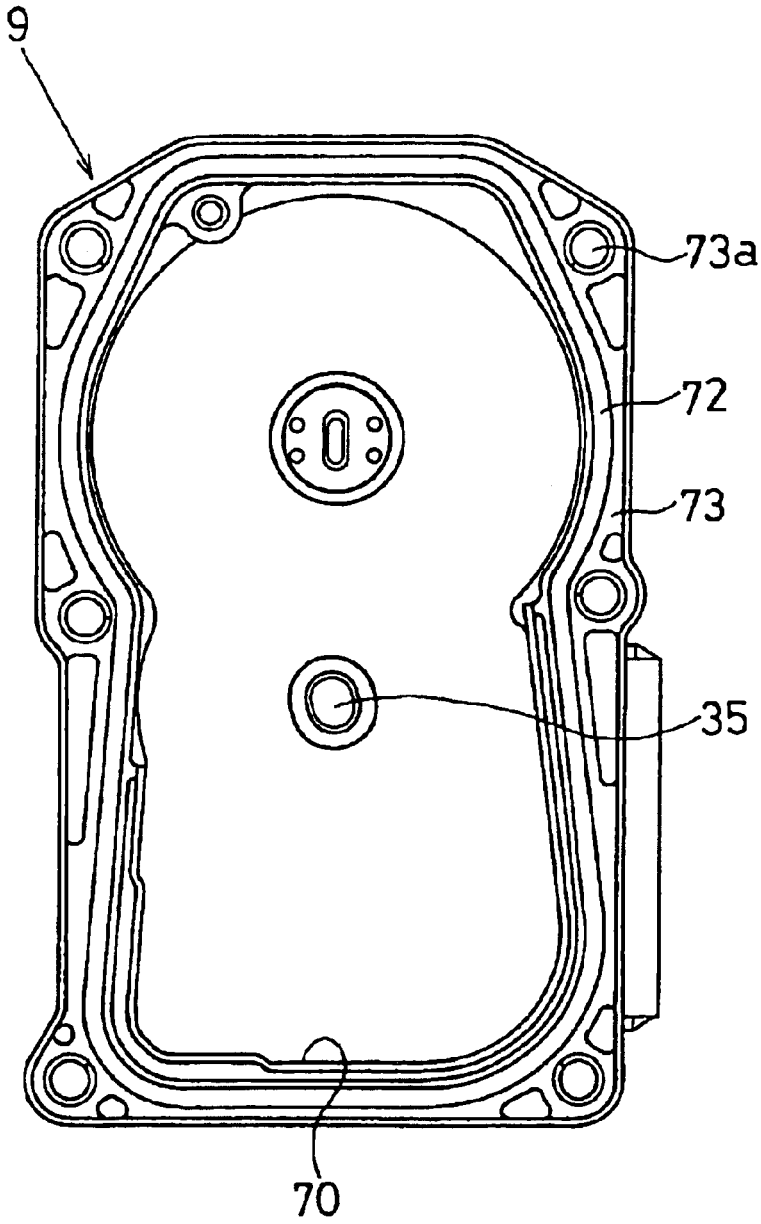
FIG. 6 is a front view showing a gear cover in the gear case integrally formed on the outer wall surface of the throttle body (second embodiment)
Figure 7:
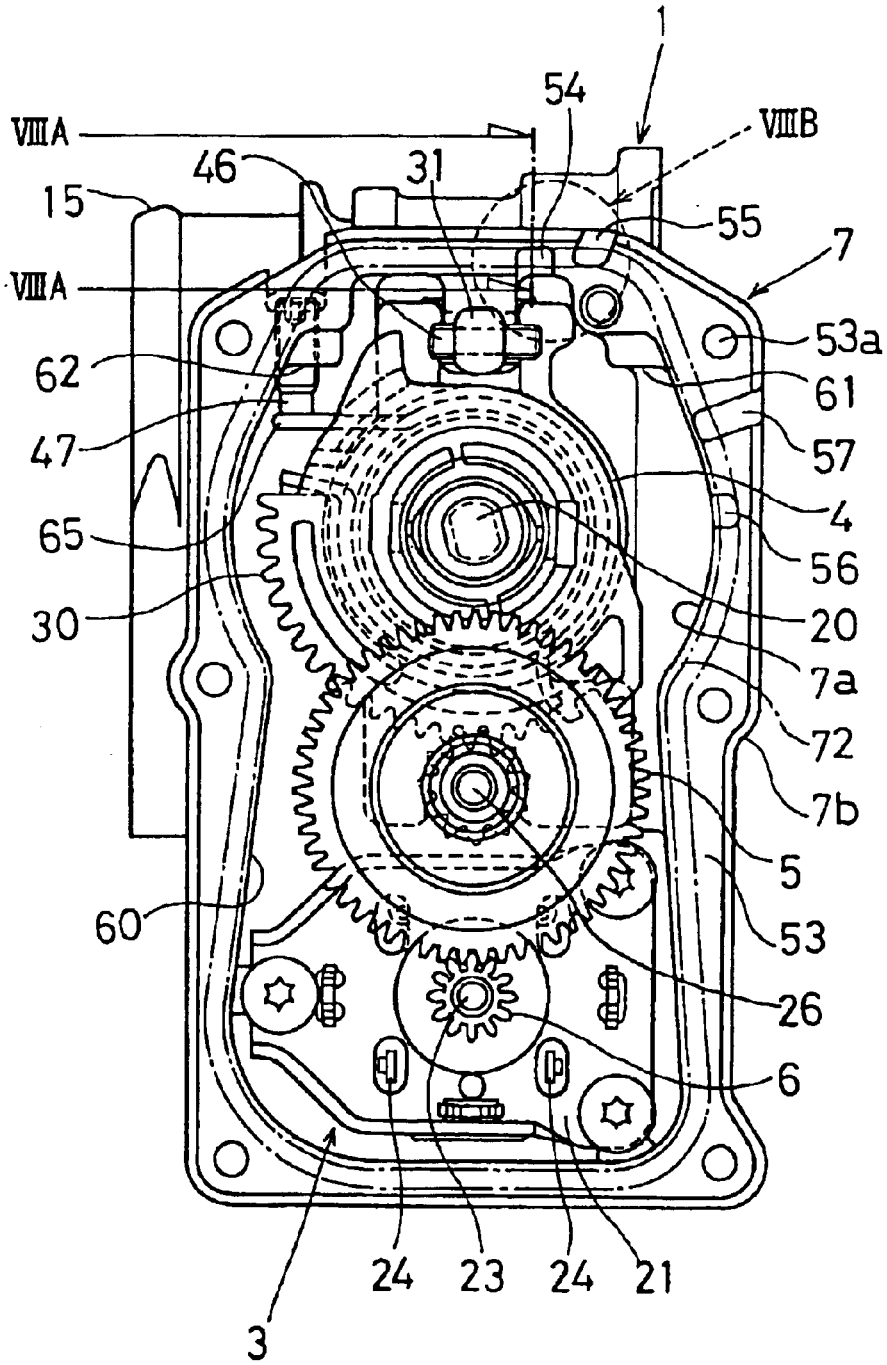
FIG. 7 is a front view showing the throttle body with a water drain/ventilation structure (second embodiment)
Figure 8A:
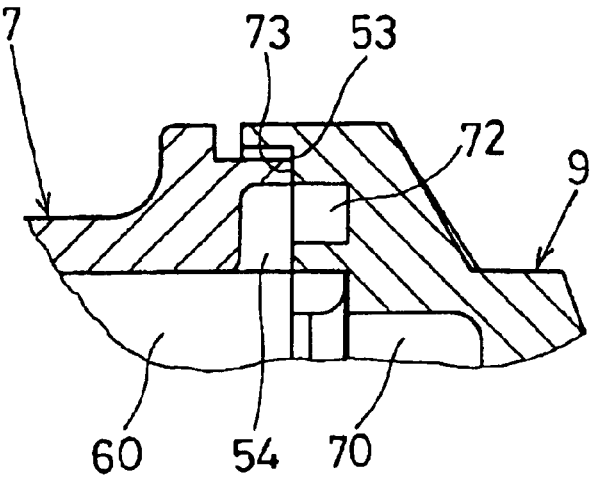
FIG. 8A is a sectional view taken along the line VIIIA—VIIIA of FIG. 7
Figure 8B:
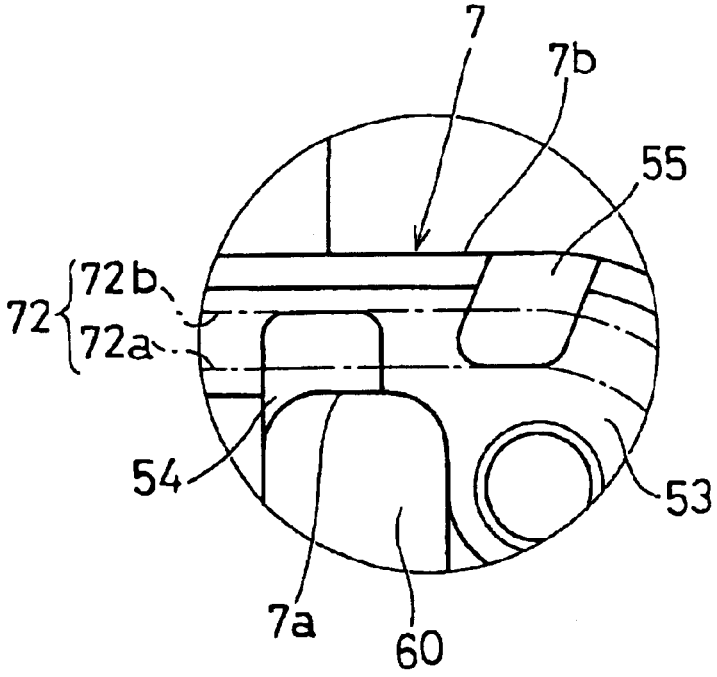
FIG. 8B shows the area VIIIB of FIG. 7 in enlarged form (second embodiment)

Also, the default spring 64 is the second spring which is a coil made of round bar spring steel and has an opener function to open the throttle valve 2 from its full close position to an intermediate position through the opener 36. At one end of the return spring 63, there is a spring body-side hook (first portion to be hooked) 66 which is hooked or held by a body-side spring hook (first hook) 41 integrally formed on the outer wall surface of the bore wall portion 15 of the throttle body 1, or on the bottom wall surface of the gear case 7, namely by the first hook 41 on the throttle body 1 side. The first hook 41 is a boss type projection on the right of the longitudinal centerline (II—II) of the gear case 7 as shown in FIGS. 1, 4 and 5.

A boss type second hook 42 is provided on the bottom wall surface of the gear case 7. In other words, the boss type second hook 42 is on the left of the longitudinal centerline (II—II) of the gear case 7, or symmetrically opposite to the above first hook 41 with respect to the longitudinal centerline (II—II) of the gear case 7. The first and second hooks 41 and 42 are symmetric with respect to the longitudinal centerline (II—II) of the gear case 7. At the other end of the default spring (the other coil spring end) 64, there is a spring gear-side hook (second portion to be hooked) which is hooked or held by a valve gear-side spring hook (second hook) 49 of the opener 36 on the valve gear-side 4. The full close position stopper 31, first and second hooks 41, 42 and first and second full open position stoppers 61, 62 are components housed in the gear case according to the present invention.

As shown in FIG. 2, the gear cover 9 is made of a thermoplastic resin which electrically insulates the above throttle position sensor terminals. The gear cover 9 has a collar-type joint end face 73 which is secured on the collar type joint end face (holder) 53 provided on the opening side of the gear case 7, with fixing bolts or fastening screws (not shown).

There are a plurality of screw holes 53*a* in the joint end face 53 of the gear case 7 into which fixing bolts or fastening screws are screwed. Also, there are a plurality of insertion holes 73*a* through which fasteners such as fixing bolts or fastening screws are passed, in the joint end face 73 of the gear cover 9. In the joint end face 73 of the gear cover 9, there is a loop groove 72 into which a rubber loop sealing material (elastic sealant, gasket or rubber packing, not shown) is fitted to prevent foreign matter from getting into the gear case 7.

According to the first embodiment, in normal operation of the electronically controlled throttle control apparatus, the throttle valve 2 opens from its intermediate position in the following sequence. As the driver depresses the accelerator pedal, an accelerator position signal from the accelerator opening degree sensor enters the ECU. The ECU energizes the drive motor 3 so as to attain a specific opening degree of the throttle valve 2 and the motor shaft 23 of the drive motor 3 rotates. As the motor shaft 23 rotates, the pinion gear 6 rotates counterclockwise as shown in FIG. 1 to transmit the torque to the larger diameter gear 28 of the intermediate reduction gear 5. As the larger diameter gear 28 rotates, the smaller gear 27 rotates around the intermediate shaft 26 clockwise as shown in FIG. 1, which rotates the valve gear 4 having the gear part 30 engaged with the smaller gear 27.

The engaging part 43 of the opener 36 pushes the U-shaped hook portion 65 at the joint between the return spring 63 and default spring 64 of the one coil spring against the force of the return spring 63. As the valve gear 4 rotates in the opening direction, the spring body-side hook 66 allows the return spring 63 hooked or held by the first hook 41 integrally formed on the outer wall surface of the bore wall portion 15 of the throttle body 1 to generate a force to return the throttle valve 2 from its full open position to the intermediate position through the opener 36.

As a consequence, the valve gear 4 rotates around the throttle shaft 20 counterclockwise as shown in FIG. 1. When the throttle shaft 20 rotates by a given angle, the throttle valve 2 rotates from its intermediate position toward its full open position (opening direction). The force of the default spring 64 is irrelevant to rotation of the throttle valve 2 in the opening direction; the opener 36 is maintained between the joint side end of the default spring 64 and the spring gear-side hook 67.

On the other hand, in normal operation of the electronically controlled throttle control apparatus, the throttle valve 2 closes from its intermediate position in the following sequence. As the driver releases the accelerator pedal, the drive motor 3 rotates in the reverse direction and thus the throttle valve 2, the throttle shaft 20, and the valve gear 4 rotate in the reverse direction.

The second hook 49 of the opener 36 pushes the spring gear-side hook 67 of the default spring 64 against the force of the default spring 64. As the valve gear 4 rotates in the closing direction, the spring gear-side hook 67 allows the default spring 64 hooked or held by the second hook 49 of the opener 36 to generate a force to return the throttle valve 2 from its full close position to its intermediate position through the opener 36.

As a consequence, the valve gear 4 rotates around the throttle shaft 20 clockwise as shown in FIG. 1. When the throttle shaft 20 rotates by a given angle, the throttle valve 2 rotates from its intermediate position toward its full close position (closing direction, the direction reverse to the opening direction of the throttle valve 2). Then, the full close stopper 32 integrally formed around the valve gear 4 abuts on the full close stopper member 46, which holds the throttle valve 2 in its full close position. The force of the return spring 63 is irrelevant to the rotation of the throttle valve 2 in the closing direction. The intermediate position is the turning point where the direction of an electric current flow to the drive motor 3 is reversed.

It is assumed here that an electric current to the drive motor 3 is shut off for some reason. Here, the opener 36 is sandwiched between the joint side end of the default spring 64 and the spring gear-side hook 67, and due to the return spring function of the return spring 63 (namely the spring force to return the throttle valve 2 from the full open position to the intermediate position through the opener 36) and the default spring function of the default spring 64 (namely the spring force to return the throttle valve 2 from the full close position to the intermediate position through the opener 36), the engaging part 43 of the opener 36 abuts on the U-shaped hook portion 65 of the one coil spring. This ensures that the throttle valve 2 is held in its intermediate position and the car can move to a safe place even if an electric current to the drive motor 3 is shut off for some reason.

As discussed above, in the electronically controlled throttle control apparatus according to this embodiment, the following components inside the gear case 7 integrally formed on the outer surface of the bore wall portion 15 of the throttle body 1 are in alignment with the longitudinal centerline (II—II) of the gear case 7: the valve gear 4 fixed to one end of the throttle shaft 20; the intermediate reduction gear 5 rotatably engaged around the intermediate shaft 26; the pinion gear (motor-side gear) 6 fixed to the motor shaft 23 of the drive motor 3; and the full close position stopper 31 which defines the full close position of the throttle valve 2.

Furthermore, as components inside the gear case 7, the first full open position stopper 61 and the second full open position stopper 62 are symmetric with respect to the longitudinal centerline of the gear case 7, and the bottom face of the first full open position stopper 61 and the bottom face of the second open position stopper 62 are flush with each other. The body-side spring hooks (first and second hooks) 41, 42 which hook the spring body-side hook 66 of the return spring 63 of the one coil spring are symmetric with respect to the longitudinal centerline (II—II) of the gear case 7.

When the components inside the gear case 7 integrally formed on the outer surface of the throttle body 1 are in alignment with the longitudinal centerline of the gear case 7, or symmetric in shape or position with respect to the longitudinal centerline of the gear case 7, they can be used as common components for different models even if the rotation direction of the motor shaft 23 of the drive motor 3 and the valve gear 4 differs.

Therefore, the components inside the gear case 7 integrally formed on the outer surface of the bore wall portion 15 of the throttle body 1 can be used as common components just by changing the bore inside diameter depending on the engine displacement and the model, namely among models with the same throttle body bore inside diameter. If the bore diameter of the throttle body 1 is identical, the number of required variations (shape and type) of the gear case 7 can be halved. Thus, for presumably all models, it is possible to decrease the number of components and reduce cost.

Conventionally, it was necessary to use either of mirror-symmetric components depending on the car steering mechanism position (for example, either right-hand drive or left-hand drive) or according as whether the motor shaft 23 of the drive motor 3 and the valve gear 4 rotate in the forward direction or reverse direction. On the other hand, according to this embodiment, all that should be done is to use the valve gear 4 and the one coil spring with the return spring 63 and default spring 64 wound in opposite directions. As a result, regardless of the rotation direction of the motor shaft 23 of the drive motor 3 and the valve gear 4, all other components inside the gear case 7 can be used as common components so that, for presumably all models, it is possible to decrease the number of components and reduce cost.

For example, for a car with a steering mechanism on the right of the longitudinal centerline of the body (right-hand drive car), or when the motor shaft 23 of the drive motor 3 rotates in the normal direction, or when the gear case 7 is integrally formed on one side in a direction perpendicular to the direction of intake air flow in the intake pipe or the bore of the throttle body 1 (for example, the front side in the longitudinal direction of the body, or the upper side in the vertical direction of the body or the right side in the left-right direction of the body), the valve gear 4 shown in FIG. 1 is adopted.

Further, the full close stopper member 46 protrudes from the left end face of the full close position stopper 31 by a given amount. The intermediate stopper member 47 protrudes from the bottom end face of the second full open position stopper 62 by a given amount. The winding direction of the return spring 63 of the one coil spring is opposite to that of the default spring 64. With this arrangement, the gear case 7 as shown in FIG. 5, which has the valve gear 4 symmetrically opposite to the valve gear 4 shown in FIG. 1 (full close position stopper 31, first and second hooks 41, 42, first and second full open position stoppers 61, 62), the intermediate reduction gear 5, the pinion gear 6, the front frame 21, and the intermediate shaft 26 can be used as common components.

On the other hand, for a car with a steering mechanism on the left of the longitudinal centerline of the body (left-hand drive car), or when the motor shaft 23 of the drive motor 3 rotates in the reverse direction, or when the gear case 7 is integrally formed on one side in a direction perpendicular to the direction of intake air flow in the intake pipe or the bore of the throttle body 1 (for example, the front side in the longitudinal direction of the body, or the upper side in the vertical direction of the body or the right side in the left-right direction of the body), the valve gear 4 as shown in FIG. 5 is adopted.

Further, the full close stopper member 46 protrudes from the right end face of the full close position stopper 31 by a given amount. The intermediate stopper member 47 protrudes from the bottom end face of the first full open position stopper 61 by a given amount. The winding direction of the return spring 63 of the one coil spring is opposite to that of the default spring 64. With this construction, the gear case 7 (full close position stopper 31, first and second hooks 41, 42, first and second full open position stoppers 61, 62) adopting a valve gear 4, which is as shown in FIG. 1 symmetrically opposite to the valve gear 4 shown in FIG. 5, the intermediate reduction gear 5, the pinion gear 6, the front frame 21, and the intermediate shaft 26 can be used as common components.

Further, it is assumed that either the first full open position stopper (right) used as the first full open position stopper 61 or the second full open position stopper (left) used as the second full open position stopper 62 has an intermediate stopper member (default stopper) 47 with an adjusting screw function. With this arrangement, the throttle body 1 may use either one coil spring having both a return spring 63 function and a default spring 64 function or two independent coil springs (a return spring and a default spring), and in either case, equivalent return spring and default spring functions are provided.

[Second Embodiment]

As shown in FIGS. 6, 7, 8A and 8B, around the opening side end of the gear cover 9 in this embodiment, there is an eaves or collar type joint end face (portion to be attached) 73 which circularly surrounds the concave (externally convex) gear housing 70 housing one end of the reduction gear. In this joint end face 73 on the gear cover side, there is a loop groove 72 which is recessed (concave) from the surrounding joint end face 73 by a specific amount.

Around the opening side end of the gear case 7 integrally formed on the bore wall portion 15 of the throttle body 1, there is an eaves or collar type joint end face (holder) 53 which circularly surrounds the concave gear housing 60 housing the other end of the reduction gear. In the joint end face 53 on the throttle body 1 side (gear case 7 side), there are a plurality of through holes 54 to 57 which connect the inside of the gear case 7 to the outside of the gear case 7 (gear cover 9) through the loop groove 72 in the joint end face 73 of the gear cover 9.

Regarding the through holes 54 to 57 made in the joint end face 53, the primary through holes 54, 56 on the inside of the gear case 7 and the secondary through holes 55, 57 on the outside of the gear case 7 are displaced left/right or up/down by a specific amount. In short, the plural through holes and the loop groove 72 make up a labyrinth structure. The primary through holes 54, 56 extend from the inner wall surface 7*a* of the gear case 7 to the outside groove wall face 72*b* of the loop groove 72 of the gear cover 9, while the secondary through holes 55, 57 extend from the outer wall face 7*b* of the gear case 7 to the inside groove wall face 72*a* of the loop groove 72 of the gear cover 9. In this embodiment, the primary and secondary through holes 54 to 57 and the loop groove 72 function as air holes (vent holes) connecting the inside and outside of the gear housings 60, 70 or water drain holes.

When the actuator for rotating the throttle valve 2 and throttle shaft 20, namely the drive motor, and the reduction gear are housed in a hermetically sealed actuator case, if the case is splashed with water in summer or under any other condition, the temperature difference between the inside and outside of the case results in an air pressure difference. This causes water to get into the actuator case through the gap between the case body joint end face and the cover joint end face. One method of preventing this is to make vent holes to make the inside and outside of the actuator case communicate with each other to minimize temperature rise in the actuator case. However, during a rainfall or car washing, water often penetrated into the actuator case.

If the actuator case should be installed in a place where temperature change is larger than in other places, the air inside the actuator case often expands and contracts with ambient temperature change, causing an air pressure difference between the inside and outside of the actuator case. If the actuator case becomes cool, the air inside it will contract, a negative pressure will be generated, and as much air as to match the negative pressure will be taken in. If this kind of ventilation should occur and there should be a water film over a vent hole, water could get into the actuator case instead of air. As a consequence, the actuator case could have a water pool inside, resulting in malfunctioning of the reduction gear or drive motor housed in the actuator case.

On the other hand, the electronically controlled throttle control apparatus in this embodiment offers the following advantages in addition to the effects of the first embodiment. Since the through holes and loop groove 72 function as vent holes and water drain holes and form a labyrinth structure, the water-tightness of the actuator case, composed of the gear case 7 and gear cover 9, is improved. This prevents water from getting into the actuator case, thereby minimizing the possibility of malfunctioning of the reduction gear or drive motor 3 or poor insulation between the two motor feeding terminals 24 and two motor connecting terminals (not shown) of the drive motor 3. The overall passage length of the labyrinth (vent holes and water drain holes) composed of the through holes and loop groove 72 in a limited space can be increased so that the space for vent holes and water drain holes can be saved.

[Third Embodiment]

Figure 9:
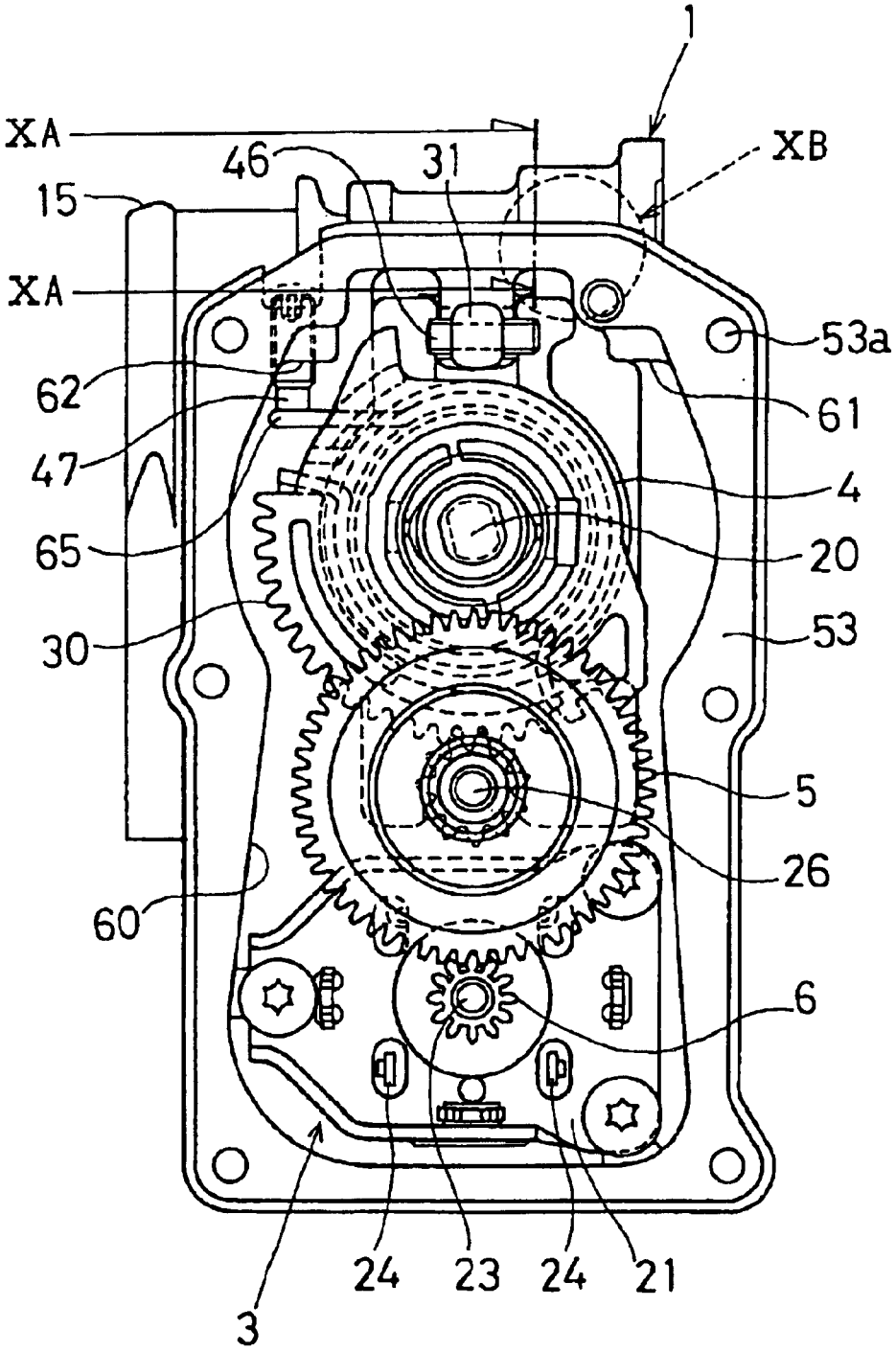
FIG. 9 is a front view showing a waterproof throttle body (third embodiment)
Figure 10A:
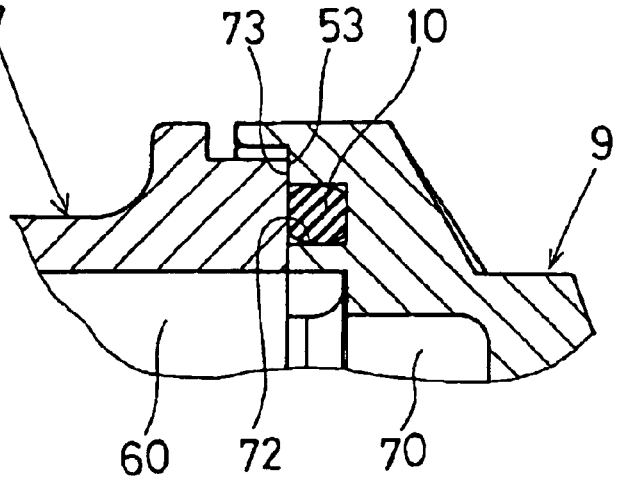
FIG. 10A is a sectional view taken along the line XA—XA of FIG. 9
Figure 10B:
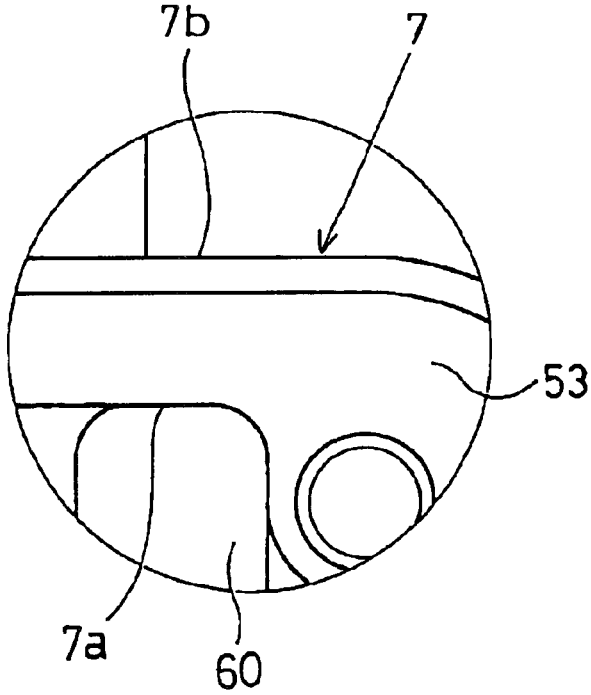
FIG. 10B shows the area XB of FIG. 9 in enlarged form (third embodiment)
Figure 11:
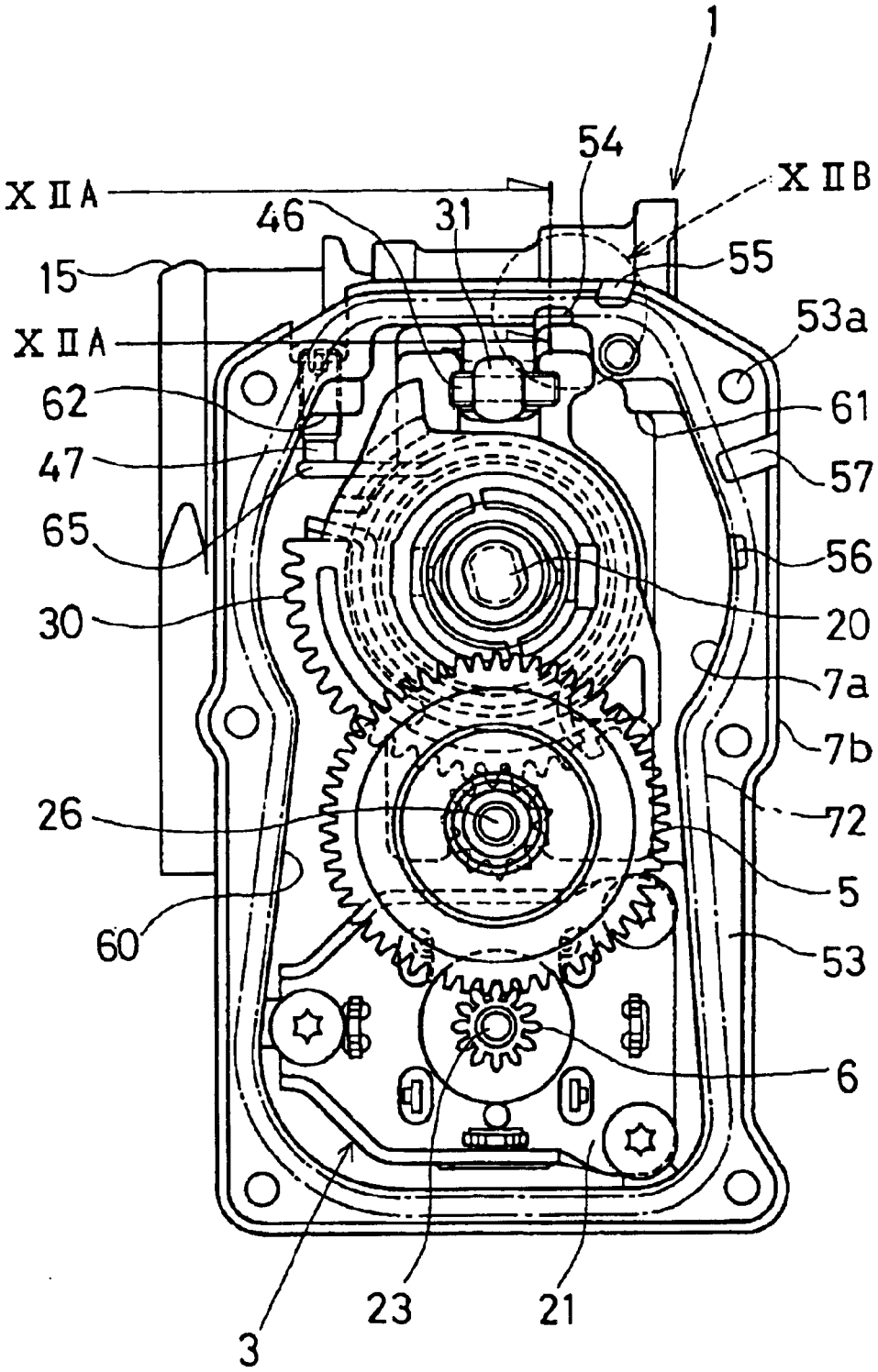
FIG. 11 is a front view showing a waterproof throttle body (fourth embodiment)
Figure 12A:
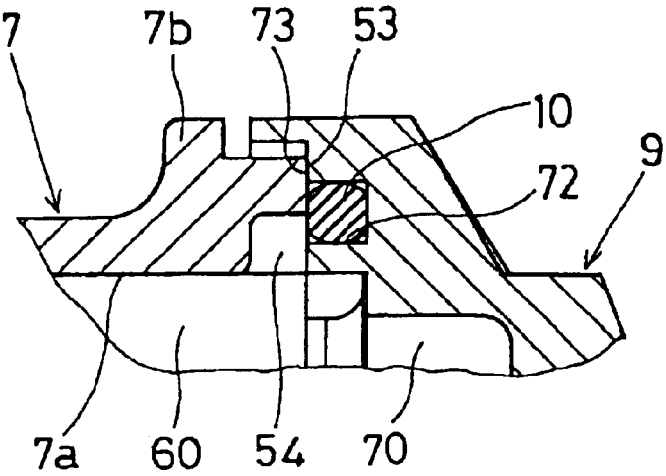
FIG. 12A is a sectional view taken along the line XIIA—XIIA of FIG. 11
Figure 12B:
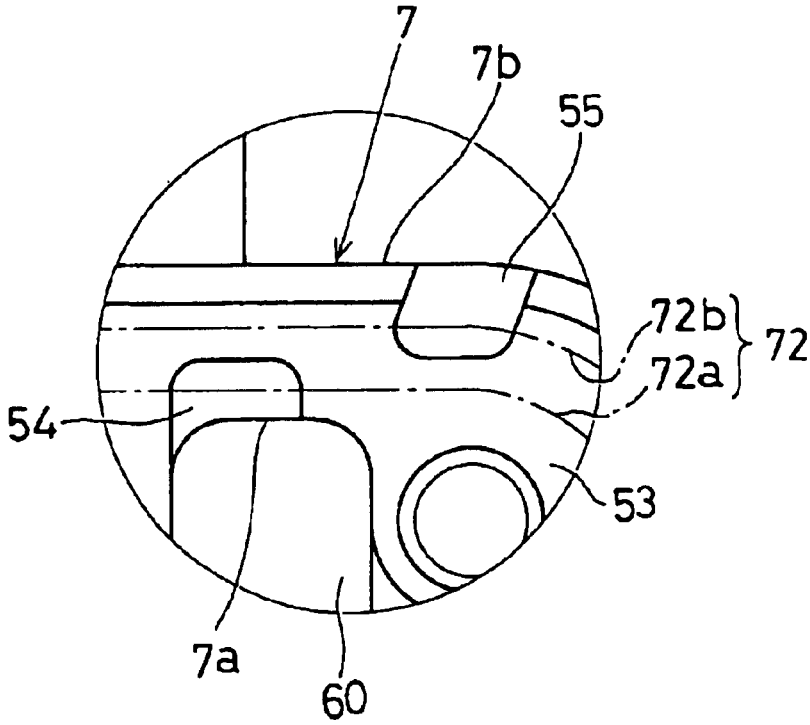
FIG. 12B shows the area XIIB of FIG. 11 in enlarged form (fourth embodiment).

In this embodiment, as opposed to the second embodiment, there are no longer primary and secondary through holes 54 to 57 in the joint end face 53 of the throttle body 1 (gear case 7). Instead, as shown in FIGS. 9, 10A and 10B, a loop sealing material (elastic sealant, gasket, or rubber packing) 10 is inserted into the loop groove 72 made in the joint end face 73 of the gear cover 9 in order to prevent water from getting into the gear housings 60 and 70 located between the gear case 7 and gear cover 9.

Adopting the throttle body 1 of a waterproof structure that the loop sealing material 10 is inserted between the joint end face 53 of the gear case 7 and the joint end face 73 of the gear cover 9 ensures that water does not get into the actuator case (composed of the gear case 7 and gear cover 9). This prevents malfunctioning of the reduction gear and the drive motor 3 and also poor insulation between the two motor feeding terminals 24 and the two motor connecting terminals (not shown) of the drive motor 3. When the loop sealing material 10 is removed from the loop groove 72 of the gear cover 9, the gear cover 9 is the same as the one in the second embodiment which closes the opening of the gear case 7 of the throttle body 1. This means that the gear cover 9 may be used for either of a throttle body 1 with a water drain/ventilation structure and a waterproof throttle body 1 and thus, for presumably all models, it is possible to decrease the number of components and reduce cost.

[Fourth Embodiment]

This embodiment also uses a waterproof throttle body as used in the third embodiment. In other words, the loop sealing material (elastic sealant, gasket, or rubber packing) 10 is inserted into the loop groove 72 made in the joint end face 73 of the gear cover 9 in order to prevent water from getting into the gear housings 60 and 70 located between the gear case 7 and gear cover 9.

In addition, there are a plurality of through holes in the joint end face 53 of the throttle body 1 (gear case 7 side), which communicate with the loop groove 72 in the joint end face 73 of the gear cover 9. Regarding these through holes, the primary through holes 54, 56 extend from the inner wall surface 7*a* of the gear case 7 to halfway across the loop groove 72 in the gear cover 9, and the secondary through holes 55, 57 extend from the outer wall surface 7*b* of the gear case 7 to halfway across the loop groove 72 in the gear cover 9.

Adopting the throttle body 1 of a waterproof structure that the loop sealing material 10 is inserted between the joint end face 53 of the gear case 7 and the joint end face 73 of the gear cover 9, enables not only the effects of the first embodiment but also the effects of the third embodiment to be produced. The same effects as those of the second embodiment are achieved simply by removing the loop sealing material 10 from the loop groove 72 of the gear cover 9, without modifying the gear cover 9 and the throttle body 1.

[Other Embodiments]

Although the above embodiments use one coil spring having both the return spring 63 and default spring 64 functions with the U-shaped hook portion 65 at the center and the U-shaped hook portion 65 is held by the intermediate stopper member (default stopper) 47, instead two independent coil springs (a return spring and a default spring) may be used with the terminal hooks of the springs held by the intermediate stopper member 47.

In embodiments which use one coil spring, the spring body-side hook (first portion to be hooked) 66 of the return spring 63 is held by the first hook (body-side spring hook) 41, or in a car with a steering mechanism on the opposite side, hooked or held by the second hook (body-side spring hook) 42 which is symmetrically opposite with respect to the longitudinal centerline of the gear case 7; and the spring gear-side hook (second portion to be hooked) 67 of the default spring 64 is hooked or held by the valve gear-side spring hook (second hook) 49.

Even when two independent coil springs are used, it is also possible that the spring body-side hook (first portion to be hooked) of the return spring is held by the first hook (body-side spring hook) 41, or in a car with a steering mechanism on the opposite side, hooked or held by the second hook (body-side spring hook) 42 which is symmetrically opposite with respect to the longitudinal centerline of the gear case 7; and the spring gear-side hook (second portion to be hooked) of the default spring is hooked or held by the valve gear-side spring hook (second hook) 49.

The above embodiments use a Hall element 13 as a non-contact detector. However, a Hall IC, magnetic resistor or the like may be used as a non-contact detector. Although the above embodiments use a separated-type permanent magnet 11 as a magnetic field source, a cylindrical permanent magnet may be used as a magnetic field source. Although the gear case 7 integrally formed on the outer wall surface of the throttle body 1 is made of metal (for example, an aluminum die cast case) and symmetric in a specific manner, the gear case 7 may be made of resin and symmetric in a specific manner.

The gear case 7 may also be integrally formed on the outer wall surface of the resin throttle body 1. Also, the intermediate reduction gear 5 may be fixed around the intermediate shaft 26 and the recess 34 of the gear case 7 and the recess 35 of the gear cover 9 may be bearings which rotatably support both ends of the intermediate shaft 26. The full open stopper 33 around the valve gear is omissible.

Still further modifications and variations are possible without departing from the spirit of the invention.

What is claimed is:

1. An electronically controlled throttle control apparatus comprising:

a throttle valve which controls an intake air flow in a bore of a throttle body;

a throttle shaft which rotates integrally with the throttle valve;

a drive motor with a motor shaft which is parallel to an axis of the throttle shaft;

a transmission system which has a valve-side gear fixed to one end of the throttle shaft, a motor-side gear fixed to one end of the motor shaft, an intermediate shaft parallel to an axis of the motor shaft, and an intermediate gear which lies between the valve-side gear and the motor-side gear and rotates around the intermediate shaft for transmitting a torque of the drive motor to the throttle shaft;

a gear case which is integrally formed on an outer wall surface of the throttle body and rotatably houses therein the valve-side gear, the motor-side gear and the intermediate gear; and a full close stopper and a full open stopper integrally formed on the valve-side gear, wherein at least the throttle shaft, the intermediate shaft and the motor shaft are in alignment with each other in the gear case, wherein components in the gear case are in alignment with a longitudinal centerline of the gear case, or symmetric in shape with respect to the longitudinal centerline of the gear case, or symmetric in position with respect to the longitudinal centerline of the gear case, wherein the components inside the gear case include a full close position stopper for defining a full close position of the throttle valve by hooking the full close stopper, and first and second full open position stoppers for defining the full open position of the throttle valve by hooking the full open stopper, wherein the full close position stopper is in alignment with a transverse centerline of the gear case, and wherein the first and second full open position stoppers are symmetric in shape with respect to the longitudinal centerline of the gear case, or symmetric in position with respect to the longitudinal centerline of the gear case.

2. The electronically controlled throttle control apparatus as in claim 1, wherein:

one of the first and second full open position stoppers has an intermediate stopper member to hook and hold the throttle valve in an intermediate position between the full close position and the full open position, in a case that the drive motor and the valve-side gear rotate in a normal direction; and the other one of the first and second full open position stoppers has an intermediate stopper member to hook and hold the throttle valve in an intermediate position between the full close position and the full open position when the drive motor and the valve-side gear rotate in the reverse direction.

3. The electronically controlled throttle control apparatus as in claim 2, further comprising:

a coil spring including a return spring and a default spring and provided between an outer wall surface of the throttle body and the valve-side gear, the return spring being for returning the throttle valve from the full open position to the intermediate position, the default spring being for returning the throttle valve from the full close position to the intermediate position, the coil spring being constructed such that a joint between the return spring and the default spring is bent into a virtually inverted U-shape thereby to form a U-shaped hook portion and that the ends of the return spring and the default spring are wound in different directions, wherein the intermediate stopper member has a hook which abuts on the U-shaped hook portion.

4. The electronically controlled throttle control apparatus as in claim 3, wherein:

the components inside the gear case further include a first hook and a second hook, the first hook being for hooking a terminal at one end of the return spring when the drive motor and the valve-side gear rotate in the normal direction, the second hook being for hooking the terminal at one end of the return spring when they rotate in the reverse direction; and the first and second hooks are symmetric in shape with respect to the longitudinal centerline of the gear case, or symmetric in position with respect to the longitudinal centerline of the gear case.

5. The electronically controlled throttle control apparatus as in claim 2, further comprising:

a return spring and a default spring which are separately provided from each other and provided between an outer wall surface of the throttle body and the valve-side gear, the return spring being for returning the throttle valve from the full open position to the intermediate position, the default spring being for returning the throttle valve from the full close position to the intermediate position, wherein the intermediate stopper member has a hook which allows a terminal hook of the return spring to abut on a terminal hook of the default spring.

6. The electronically controlled throttle control apparatus as in claim 5, wherein:

components inside the gear case include a first hook and a second hook, the first hook being for hooking a terminal at one end of the return spring in a case that the drive motor and the valve-side gear rotate in the normal direction, the second hook being for hooking a terminal at one end of the return spring in a case that the drive motor and the valve-side gear rotate in the reverse direction; and the first and second hooks are symmetric in position with respect to the longitudinal centerline of the gear case.

7. The electronically controlled throttle control apparatus as in claim 1, further comprising:

a gear cover which closes an opening of the gear case, wherein the drive motor functions as an electric actuator to rotate the motor shaft when energized through two motor energizing terminals held by the gear cover, two motor connecting terminals connected integrally with the motor energizing terminals and protruding from the gear cover toward the drive motor, and two motor feeding terminals detachably connected with the motor connecting terminals, and wherein the two motor feeding terminals are symmetric in position with respect to the gear case and the longitudinal centerline of the gear case.

8. The electronically controlled throttle control apparatus as in claim 1, further comprising:

a gear cover which closes an opening of the gear case, wherein the gear case has a collar type holder to hold the gear cover, wherein the gear cover has a portion to be attached to the holder, the portion to be attached has a loop groove; and wherein a loop sealing material is fitted into the loop groove to prevent foreign matter from getting into the gear case.

9. The electronically controlled throttle control apparatus as in claim 1, further comprising:

a gear cover which closes an opening of the gear case, wherein the gear case has a collar type holder to hold the gear cover, wherein the gear cover has a portion to be attached to the holder, wherein the portion to be attached has a loop groove, and wherein the holder has through holes which connect an inside of the gear case and an outside of the gear case through the loop groove.

10. The electronically controlled throttle control apparatus as in claim 9, wherein the through holes are used as drain holes to drain water from the inside of the gear case or as vent holes for ventilation between the inside and outside of the gear case.

11. The electronically controlled throttle control apparatus as in claim 9, wherein:

the through holes include primary through holes in the inside of the gear case and secondary through holes in the outside of the gear case and formed in a displaced manner in a mounting face of the holder;

the primary through holes extend from an inner wall surface of the gear case to an outside groove wall surface of the loop groove or to halfway across the loop groove; and the secondary through holes extend from an outer wall surface of the gear case to an inside groove wall surface of the loop groove or to halfway across the loop groove.

12. The electronically controlled throttle control apparatus as in claim 1, further comprising:

a full close stopper member coupled to the full close position stopper to adjust the full close position.

13. The electronically controlled throttle control apparatus as in claim 12, wherein the full close position stopper is a boss type component protruding from an inner wall of the gear case and has a bore defined therethrough, and said full close stopper member comprises a threaded component threadably engaged with said bore to define the full close position.

14. An electronically controlled throttle control apparatus comprising:

a throttle valve which controls an intake air flow in a bore of a throttle body;

a throttle shaft which rotates integrally with the throttle valve;

a drive motor with a motor shaft which is parallel to an axis of the throttle shaft;

a transmission system which has a valve-side gear fixed to one end of the throttle shaft, a motor-side gear fixed to one end of the motor shaft, an intermediate shaft parallel to an axis of the motor shaft, and an intermediate gear which lies between the valve-side gear and the motor-side gear and rotates around the intermediate shaft for transmitting a torque of the drive motor to the throttle shaft;

a gear case which is integrally formed on an outer wall surface of the throttle body and rotatably houses therein the valve-side gear, the motor-side gear and the intermediate gear;

a full close stopper integrally formed on the valve-side gear;

a full close position stopper inside the gear case for defining a full close position of the throttle valve by hooking the full close stopper; and a full close stopper member coupled with the full close position stopper to adjust said full close position, wherein at least the throttle shaft, the intermediate shaft and the motor shaft are in alignment with each other in the gear case, and wherein the full close position stopper is in alignment with a transverse centerline of the gear case.

15. An electronically controlled throttle control apparatus comprising:

a throttle valve which controls an intake air flow in a bore of a throttle body;

a throttle shaft which rotates integrally with the throttle valve;

a drive motor with a motor shaft which is parallel to an axis of the throttle shaft;

a transmission system which has a valve-side gear fixed to one end of the throttle shaft, a motor-side gear fixed to one end of the motor shaft, an intermediate shaft parallel to an axis of the motor shaft, and an intermediate gear which lies between the valve-side gear and the motor-side gear and rotates around the intermediate shaft for transmitting a torque of the drive motor to the throttle shaft;

a gear case which is integrally formed on an outer wall surface of the throttle body and rotatably houses therein the valve-side gear, the motor-side gear and the intermediate gear;

a full close stopper integrally formed on the valve-side gear; and a full close position stopper inside the gear case for defining a full close position of the throttle valve by hooking the full close stopper, wherein at least the throttle shaft, the intermediate shaft and the motor shaft are in alignment with each other in the gear case, wherein the full close position stopper is in alignment with a transverse centerline of the gear case, and wherein the full close position stopper is a boss type component protruding from an inner wall of the gear case and has a bore defined therethrough, and said full close stopper member comprises a threaded component threadably engaged with said bore to define the full close position.

16. An electronically controlled throttle control apparatus comprising:

a throttle valve which controls an intake air flow in a bore of a throttle body;

a throttle shaft which rotates integrally with the throttle valve:

a drive motor with a motor shaft which is parallel to an axis of the throttle shaft;

a transmission system which has a valve-side gear fixed to one end of the throttle shaft, a motor-side gear fixed to one end of the motor shaft, an intermediate shaft parallel to an axis of the motor shaft, and an intermediate gear which lies between the valve-side gear and the motor-side gear and rotates around the intermediate shaft for transmitting a torque of the drive motor to the throttle shaft;

a gear case which is integrally formed on an outer wall surface of the throttle body and rotatably houses therein the valve-side gear, the motor-side gear and the intermediate gear;

a full close stopper integrally formed on the valve-side gear;

a full close position stopper inside the gear case for defining a full close position of the throttle valve by hooking the full close stopper a full open stopper integrally formed on the valve-side gear; and first and second full open position stoppers for defining the full open position of the throttle valve by hooking the full open stopper, wherein at least the throttle shaft, the intermediate shaft and the motor shaft are in alignment with each other in the gear case, wherein the full close position stopper is in alignment with a transverse centerline of the gear case, and wherein the first and second full open position stoppers are symmetric in shape with respect to the longitudinal centerline of the gear case or symmetric in position with respect to the longitudinal centerline of the gear case.

17. The electronically controlled throttle control apparatus as in claim 16, wherein:

one of the first and second full open position stoppers has an intermediate stopper member to hook and hold the throttle valve in an intermediate position between the full close position and the full open position, in a case that the drive motor and the valve-side gear rotate in a normal direction; and the other one of the first and second full open position stoppers has an intermediate stopper member to hook and hold the throttle valve in an intermediate position between the full close position and the full open position when the drive motor and the valve-side gear rotate in the reverse direction.

18. The electronically controlled throttle control apparatus as in claim 17, further comprising:

a coil spring including a return spring and a default spring and provided between an outer wall surface of the throttle body and the valve-side gear, the return spring being for returning the throttle valve from the full open position to the intermediate position, the default spring being for returning the throttle valve from the full close position to the intermediate position, the coil spring being constructed such that a joint between the return spring and the default spring is bent into a virtually inverted U-shape thereby to form a U-shaped hook portion and that the ends of the return spring and the default spring are wound in different directions, wherein the intermediate stopper member has a hook which abuts on the U-shaped hook portion.

19. The electronically controlled throttle control apparatus as in claim 18, wherein:

the components inside the gear case further include a first hook and a second hook, the first hook being for hooking a terminal at one end of the return spring when the drive motor and the valve-side gear rotate in the normal direction, the second hook being for hooking the terminal at one end of the return spring when they rotate in the reverse direction; and the first and second hooks are symmetric in shape with respect to the longitudinal centerline of the gear case, or symmetric in position with respect to the longitudinal centerline of the gear case.

* * * * *